United States Patent [19]

Mills

[11] 4,395,932

[45] Aug. 2, 1983

[54] STRINGED INSTRUMENT PICK

[75] Inventor: Perry A. Mills, 14010 Captains Row #222, Marina Del Rey, Calif. 90291, now by change of name from Perry A. Milewski

[73] Assignee: Perry A. Mills, Marina Del Rey, Calif.

[21] Appl. No.: 345,598

[22] Filed: Feb. 4, 1982

[51] Int. Cl.[3] ..... G10D 3/16

[52] U.S. Cl. ..... 84/322

[58] Field of Search ..... 84/322

[56] References Cited

U.S. PATENT DOCUMENTS 1,787,136 12/1930 Beauchamp ..... 84/322

2,961,912 11/1960 Meola ..... 84/322

3,739,681 6/1973 Dunlop ..... 84/322

4,235,144 11/1980 Lubow et al. ..... 84/322 X

*Primary Examiner*—Lawrence R. Franklin

*Attorney, Agent, or Firm*—William H. Maxwell

[57] ABSTRACT

A stringed instrument pick of highly resilient spring material and preferably of a Beryllium Copper alloy and the like, whereby thickness is reduced to a distinct range of thinness conducive to accuracy in performance, and with initial deflections followed by instantaneous return to a planar condition without permanent deformation, for the predictable positioning of the picking edge within the fractional second time frame of plucking.

5 Claims, 3 Drawing Figures

STRINGED INSTRUMENT PICK

BACKGROUND

This invention relates to stringed instruments and particularly to picks therefor as used by guitarists and the like. The musician chooses a pick according to the strings used on the instrument and according to his style and technique of playing. Accordingly, conventional picks for stringed instruments are made in various thicknesses and of different materials such as wood, bone, stone, plastic and metals. The state of the art has preferred plastic picks, as they simulate finger plucking and are compatible with the softer instrument strings of gut. However, metal picks used with metal strings and heretofore made of steel and especially stainless-steels have not been altogether satisfactory, as they lack the necessary degree of resilience; and plastic picks also lack instant memory required for accurate plucking. Therefore, and in lieu of a mere substitution of material, it is a general object of the present invention to provide a musical instrument pick of a commercially available material having optimum physical properties as related to thickness and resilience for increased accuracy in plucking.

Plucking accuracy can be greatly increased when the instrumentalist knows exactly where the picking edge is. Discrepancy in picking edge position occurs with ordinary prior art picks made of materials which do not have an instant memory, since they allow a substantial time lag before straightening to their original condition. In some instances the lag is thirty seconds or more; and in some instances straightening is precluded by a permanent deformation. It is to be understood that the force applied to picks in plucking the instrument strings is very often most severe with the picking edge deflected 0.25 inch, more or less. Since the time interval between plucked notes is most often and consistantly a fraction of a second, a permanently or temporarily displaced positioning of the picking edge is most detrimental to instrumental execution and therefore timing and playing accuracy is adversely affected. Heretofore, inability of the performing musician to predict precise positioning of the picking edge has had an adverse affect on his performance, and all of which is aggravated by upward and downward plucking, and by switching between multiple upward and downward plucking. It is therefore an object of this invention to provide a pick which deviates the least from its original planar condition after deflection, and a pick which has an instant and substantially complete memory for this purpose. In carrying out this invention, Beryllium Copper (Be-Cu) alloy is used, an alloy that contains greater than one percent Beryllium and characterized by its high strength, hardness and resilience. The pick as it is disclosed herein is essentially a corrosion resistant spring having instant and substantially complete memory.

The range of thickness of prior art stringed instrument picks and that of plastic picks which are most widely used is 0.017 inch to 0.032 inch. By comparison, the range of thickness of the picks of the present invention is 0.005 inch to 0.010 inch. Whereas the prior art picks have been supplied in "THIN", "MEDIUM" and "HEAVY" thicknesses, the pick of the present invention is supplied in incremental thicknesses separated by 0.001 inch respectively. The planar configuration of the instant pick remains conventional according to acceptable standards, and the selected thickness provides the required spring and/or degree of resiliency desired. A feature is the compatability of Beryllium Copper brought into frictional contact with metal instrument strings, and particularly against the Nickle-Steel wrappings of guitar strings; wear being minimized thereby.

SUMMARY OF THE INVENTION

A metal pick of Beryllium Copper alloy is provided within a range of thicknesses less than conventional picks of the prior art. It is increased accuracy of playing which is an object of this invention, made possible by the refinement or thinness of the picking edge and by the physical properties of the Beryllium Copper which establishes a spring of such resilience that it returns instantly to a predictable position. As will be shown, the time factor of return to a predictable condition and positioning of the picking edge is significantly critical. As to the refinement of the picking edge, the thickest of the instant picks is 58% of the thickness of the thinnest of plastic picks; and the thinnest of the instant picks is 16% of the thickness of thickest of plastic picks. It is the thinness of the picking edge coupled with the high degree of resiliency that lends great utility to this new pick of durable and corrosion resistant spring material.

The foregoing and various other objects and features of this invention will be apparent and fully understood from the following detailed description of the typical preferred form and application thereof, throughout which description reference is made to the accompanying drawings.

PREFERRED EMBODIMENT

Figure 1:
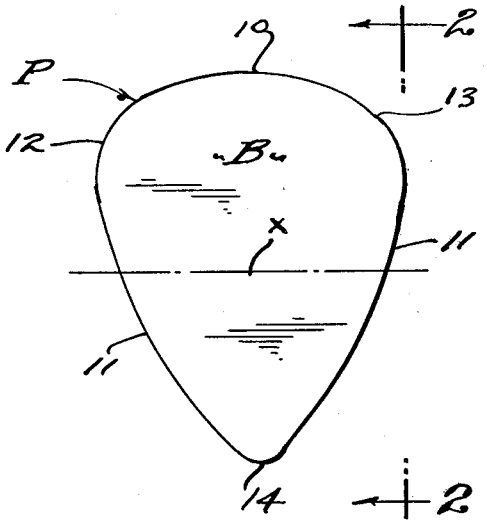
FIG. 1 is a front view of a stringed instrument pick of typical configuration.
Figure 2:
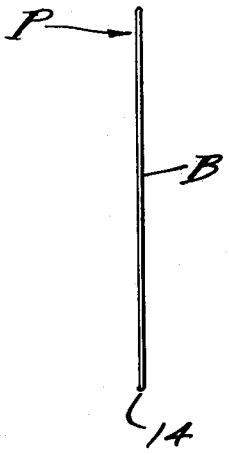
FIG. 2 is an edge view of the pick and taken as indicated by line 2—2 on FIG. 1.

Referring now to the drawings, the pick P is for the playing of stringed instruments and especially guitars with metal strings of steel wrapped with Nickle-Steel wire. The pick P is of the usual configuration, comprised of a body B of generally thin triangular plate with convexly curved top and side edges 10 and 11, and well rounded corners 12, 13 and 14. It is the lowermost corner 14 that is the picking edge. The plate or body is approximately one inch across the top edge 10, and one and three sixteenths in height to the picking edge 14. In the practice of using the pick to play an instrument, the upper portion of the flat body thereof is gripped between the thumb and index finger or fingers, thereby exposing the lower picking portion and picking edge 14. It will be readily understood how the picking edge portion is then deflected when forced against a string to pluck the same. The amount of pick deflection will vary as circumstances require to control the volume of sound by means of force applied before releasing the string. A deflection of 0.25 inch, more or less, is normal on a constant basis.

Figure 3:
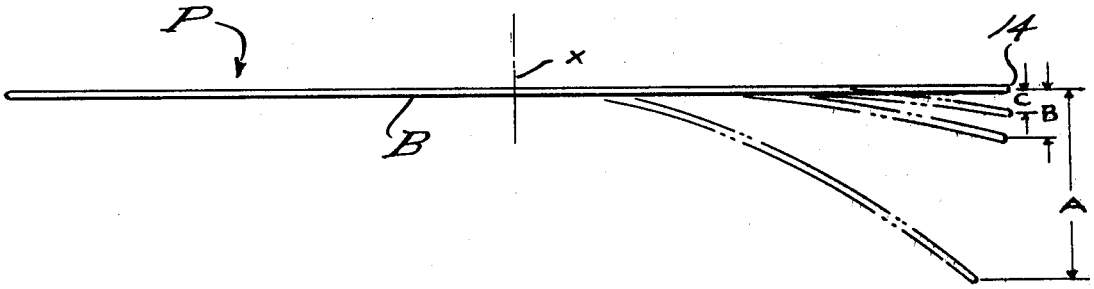
FIG. 3 is an enlarged edge view of the pick showing an initial deflection "A" and subsequent measured deformations "B" and "C", as will be described.

In FIG. 3 of the drawings I have shown the aforesaid initial deflection "A" and subsequent deformations "B" and "C" that are found to remain in the body B after measured time intervals of one second and fifteen seconds respectively, for example. It is to be observed that the said deflection and subsequent deformations are displacements from the initial flat planar condition of the pick body, all of which emanate from a common bend line x established by the grip and extending transversely of said pick body.

Memory tests conducted on Nylon plastic picks of the configuration above specified and as set forth in the following table of information have been made. These tests determined the degree of remaining deformation in picks made of Nylon plastic after measured lengths of time following a uniform initial deflection:

| NYLON PLASTIC PICKS | | | |
|---|---|---|---|
| Thickness "T" | Deflection Time-0- "A" | Deformation at-1 Sec.- "B" | Deformation at-15 Sec.- "C" |
| .017" | .250" | .020" | .005" |
| .028" | .250" | .017" | .003" |
| .032" | .250" | .012" | .002" |

In accordance with this invention the pick P is made of a spring copper alloy and preferably of Beryllium Copper (Be-Cu) whose Beryllium content is greater than one percent and characterized by its high strength, hardness and resiliency, as well as being corrosion resistant. A feature of this spring material is that its use enables the pick body to be 16% to 58% of the thickness of plastic picks and the like. Accordingly, a most satisfactory range of pick thickness has been determined to be 0.005 inch to 0.010 inch, utilizing sheet or strip Beryllium Copper alloy comprised of 1.80% to 2.05% Be, 0.18% to 0.30% Co (Cobalt) and the balance Cu; with an H temper having a tensile strength of 100,000 to 120,000 pounds per square inch, 2% to 7% elongation in 2 inches, and a Rockwell hardness of B-96 to 102. A substitute copper alloy is wrought Sheet Brass known commercially as Composition No. 70A, an alloy comprised of 68.5% to 71.5% Cu (Copper), a maximum of 0.07% Pb (Lead), a maximum of 0.05% Fe (Iron), and the remainder Zn (Zinc); with a "Spring" or an "Extra Spring" temper having a tensile strength of 91,000 to 104,000 pounds per square inch, and a Rockwell hardness of B-89 to 95. Other substitute metals are Phosphor Bronze and Red Brass, in their commercially available forms and spring temper.

Memory tests conducted on these Beryllium Copper picks of the same configuration as said Nylon plastic picks and of the above specified alloy, and as set forth in the following table of information have been made. These tests determine the degree of remaining deformation in picks made of said Beryllium Copper after measured lengths of time following a uniform initial deflection:

| BERYLLIUM COPPER PICKS | | | |
|---|---|---|---|
| Thickness "T" | Deflection Time-0- "A" | Deformation at-1 Sec.- "B" | Deformation at-15 Sec.- "C" |
| .005" | .250" | .001" | .0005" |
| .006" | .250" | .001" | .0005" |
| .007" | .250" | .001" | .0005" |
| .008" | .250" | .0005" | .000" |
| .009" | .250" | .000" | .000" |
| .010" | .250" | .000" | .000" |

Stainless Steel or Chromium Nickel Austenitic Steels are not capable of heat treatment, and although capable of attaining tensile strengths of 85,000 to 125,000 pounds per square inch, they are ductile and the resiliency thereof is substantially inferior to that of Beryllium Copper spring material. The most widely used austenitic steel is SAE 30302, and such material is not compatable with the similar wrapping of Stainless, Nickel Steel, wire on the instrument strings, as wear is induced thereby.

It will be observed by comparison of the foregoing test tables that the Beryllium Copper picks of the present invention are 16% to 58% the thickness of conventional Nylon plastic picks, and accordingly the potential degree of accuracy in plucking is commensurately improved. It will also be observed that the ranges of thickness are distinct and not overlapping, in that prior art picks are within the thicker range of 0.017 inch to 0.032 inch, and the same is true of prior art metal picks, whereas the spring picks of the present invention are within the thinness range of 0.005 inch to 0.010 inch. The performance deflection required within the 0.017–0.032 thickness range of said Nylon plastic picks is substantially the same as the performance deflection required within the 0.005–0.010 thickness range of said Beryllium Copper picks, and a severe performance deflection is in each instance approximately 0.25 inch. Accordingly, a 0.250 inch initial deflection is used in the aforementioned tests. It will be observed that the least 0.002 inch deformation, after 15 seconds, of the Nylon plastic pick is 200% that of the greatest 0.001 inch deformation after one second of the Beryllium Copper pick. Further, it will be observed that the average 0.0163 inch deformation of the three Nylon plastic picks, after one second, far exceeds that of the average 0.00058 inch deformation of the six Beryllium Copper picks, within the performance range of thicknesses. Still further, it will be observed that the average 0.003 inch deformation of the three Nylon plastic picks, after fifteen seconds, is also far greater than that of the average 0.00025 inch deformation of the six Beryllium Copper picks, within the performance range of thicknesses. Whereas the Nylon plastic pick deformation remains significantly great, the Beryllium Copper pick deformation is significantly small and negligible; and is not measurable as a practical matter in heavier or thicker Beryllium Copper picks. Thus, within the fractional second time frame of plucking an instrument string, the Beryllium Copper pick of the present invention is entirely predictable and a decided improvement over prior art picks which are cumbersome and lacking in resilience and without complete and instant memory.

From the foregoing it will be understood that a resilient and compatible wear resistant pick is much to be desired, and that dexterity of the instrumentalist can be greatly improved by decreasing the thickness of the pick. The stiffness of prior art metal picks has defeated the capabilities of the instrumentalist, since resilience thereof has been lacking. The thickness of prior art plastic picks has also defeated the capabilities of the instrumentalist, since they are more cumbersome than the instant thinner picks. The range of resilience is cooperatively related to the range of thickness, and it will be seen that the pick of the present invention is within a range of thickness inside the range of thickness of the prior art picks. It is significant that the range of 0.005 inch to 0.010 inch is thinner than the prior art range of 0.017 inch to 0.032 inch, so that accuracy in plucking is now commensurately increased. It is the cooperative relation of the range of thickness or thinness with the spring body of Beryllium Copper that provides a pick having a high degree of resilience for large excursions of deflection while retaining substantially complete and instant memory, also a requisite for accuracy in performance of the musician.

Having described only a typical and preferred form and application of my invention, I do not wish to be limited or restricted to the specific details herein set forth, but wish to reserve to myself any modifications or variations that may appear to those skilled in the art as set forth within the limits of the following claims.

I claim:

1. A pick for plucking musical instrument strings and comprised of a planar body of Beryllium Copper alloy whose Beryllium content is greater than one percent and of spring temper having a picking edge spaced from a bend line extending transversely of the planar body, said planar body being of a thickness cooperating with the physical properties of the spring metal establishing an initial deflection when forced against a string followed by instantaneous and complete return to the planar condition when released from the string.

2. The musical instrument pick as set forth in claim 1, wherein the Beryllium Copper alloy is comprised of 1.80% to 2.05% Beryllium, 0.18% to 0.30% Cobalt, and the balance Copper.

3. The musical instrument pick as set forth in claim 1, wherein the Beryllium Copper alloy is comprised of 1.80% to 2.05% Beryllium, 0.18% to 0.30% Cobalt, and the balance Copper, and wherein the temper thereof has a tensile strength of 100,000 to 120,000 pounds per square inch with a Rockwell hardness of B-96 to 102.

4. The musical instrument pick as set forth in any one of claims 1, 2 or 3, wherein the planar body thickness is less than 0.017 inch.

5. The musical instrument pick as set forth in any one of claims 1, 2 or 3, wherein the planar body thickness is at least 0.005 inch and not greater than 0.010 inch.

* * * * *